US007392550B2

(12) United States Patent
Miwa et al.

(10) Patent No.: US 7,392,550 B2
(45) Date of Patent: Jul. 1, 2008

(54) SILENCER AND WATER SUPPLY DEVICE

(75) Inventors: Koji Miwa, Tokoname (JP); Kenichi Ito, Tokoname (JP)

(73) Assignee: Inax Corporation, Tokoname-shi (JP)

( * ) Notice: Subject to any disclaimer, the term of this patent is extended or adjusted under 35 U.S.C. 154(b) by 426 days.

(21) Appl. No.: 10/524,212

(22) PCT Filed: Aug. 15, 2003

(86) PCT No.: PCT/JP03/10396

§ 371 (c)(1),
(2), (4) Date: Feb. 10, 2005

(87) PCT Pub. No.: WO2004/018786

PCT Pub. Date: Mar. 4, 2004

(65) Prior Publication Data

US 2005/0188453 A1 Sep. 1, 2005

(30) Foreign Application Priority Data

Aug. 21, 2002 (JP) ..... 2002-240804

(51) Int. Cl.
*E03D 11/18* (2006.01)

(52) U.S. Cl. ..... 4/425

(58) Field of Classification Search ..... 4/425
See application file for complete search history.

(56) References Cited

U.S. PATENT DOCUMENTS 1,630,861 A 5/1927 Opdyke
5,832,546 A 11/1998 Inch

FOREIGN PATENT DOCUMENTS

| | | |
|---|---|---|
| JP | 4-177051 | 6/1992 |
| JP | 2002-106044 | 4/2002 |
| JP | 2003-147841 | 5/2003 |

*Primary Examiner*—Charles E. Phillips
(74) *Attorney, Agent, or Firm*—Oblon, Spivak, McClelland, Maier & Neustadt, P.C.

(57) ABSTRACT

A muffling apparatus capable of attaining the prevention of the occurrence of a noise reliably while making concrete the reduction of the manufacturing cost and the easiness of the assembling of the same apparatus, and a feed water apparatus having such a muffling effect are provided. The muffling apparatus 2 is an apparatus connected to a jet pipe 1 adapted to send out the water, which flows in a feed water passage 1*a* in the interior thereof, into storage water W. The apparatus has a tubular portion 4 connected to an upstream side portion of the jet pipe 1 so that the tubular portion 4 extend downward, and having therein a water supply passage 4*a* communicating with the feed water passage 1*a*, and a housing 3 connected water-tightly to an upstream side portion of the jet pipe 1 and an upper section of the tubular portion 4, enclosing a lower section of the tubular portion 4, connected water-tightly to a downstream side portion of the jet pipe 1, and capable of storing the air, which is in the interior of the jet pipe 1, in the portion of the interior of the housing 3 which is outside the tubular portion 4. The tubular portion 4 is provided at an upper section thereof with an air hole 4*b* made through a wall thereof so as to communicate the water supply passage 4*a* with the interior of the housing 3.

2 Claims, 9 Drawing Sheets

SILENCER AND WATER SUPPLY DEVICE

TECHNICAL FIELD

This invention relates to a muffling apparatus and a feed water apparatus to which this muffling apparatus is connected.

BACKGROUND ART

For example, a Western style flush toilet stool is provided with a washing apparatus having a jet pipe as a feed water pipe. This jet pipe is adapted to send out the water, which flows in a feed water passage in an inner portion thereof, into storage water in a bowl portion. In this jet pipe, the air is left in a position higher than a level of the storage water when a preceding washing operation finishes. Therefore, when fresh washing water is supplied into the jet pipe by the washing apparatus so as to carry out a subsequent washing operation in this condition, the air left in the jet pipe is blown out in a lump at a stroke in a water pressure-compressed condition into the storage water, so that a comparatively large noise occurs. The same phenomenon occurs in a hot water supply apparatus and the like adapted to send out additional hot water, etc. into hot water stored in a bath tub.

Regarding the matter, JP-A-2002-106044 discloses a muffling apparatus connected to a jet pipe of a Western style flush toilet stool. This muffling apparatus includes a branch pipe diverging horizontally from the jet pipe and bent upward, a housing connected water-tightly to an upper end of this branch pipe and having at an upper end thereof a port opened in the atmospheric air, and a valve provided vertically movably in the housing and adapted to float by a buoyancy of the air and open the port of the housing. When the washing water is supplied into the jet pipe in this Western style flush toilet stool provided with this muffling apparatus, the air left in the jet pipe is introduced into the muffling apparatus, and then discharged to the atmospheric air. In short, the air left in the interior of the jet pipe is liable to be transferred to the branch pipe by a buoyancy thereof while the air is moved in the jet pipe by the water pressure, and the air transferred to the branch pipe reaches the interior of the housing. Since the valve floats in the interior of the housing owing to the air, the port of the housing is thereby opened, so that the air is discharged to the atmospheric air via the port. Thus, in the Western style flush toilet stool provided with a muffling apparatus, the air left in the interior of the jet pipe is rarely blown out into the storage water. Therefore, it is considered that the noise occurring when the air is blown out in a lump at a stroke into the storage water can be prevented.

DISCLOSURE OF THE INVENTION

Problems to be Solved by the Invention:

However, this related art muffling apparatus has a branch pipe diverging from the jet pipe and also the valve operated in the housing. Therefore, this muffling apparatus abounds in the number of parts and is complicated in the construction. This causes an increase in the manufacturing cost, and the assembling work becomes troublesome. Moreover, in this muffling apparatus, the valve is moved vertically in accordance with the air storing and discharging operations, so that, when the valve is difficult to be moved smoothly, it is difficult to expect the obtaining of a muffling effect.

The present invention has been made in view of these facts in the related techniques, and is aimed at providing a muffling apparatus which can attain the prevention of noise reliably while effecting a decrease in the manufacturing cost and the easiness of an operation for assembling the apparatus; and a feed water apparatus having such a muffling effect.

Means for Solving the Problems:

A muffling apparatus according to a first invention relates to a muffling apparatus connected to an intermediate portion of a feed water pipe adapted to send out water, flowing through a feed water passage therein, into storage water, the improvement is characterized in that the muffing apparatus includes a tubular portion, connected in a downwardly extending state to an upstream side feed water pipe portion positioned on an upstream side of the muffling apparatus, of the feed water pipe, the tubular portion having in the interior there of a water supply passage communicating with the feed water pipe, and a housing connected water-tightly to the upstream side feed water pipe portion and an upper section of the tubular portion, enclosing a lower section of the tubular portion therewith, connected water-tightly to a downstream side feed water pipe portion positioned on a downstream side of the muffling apparatus, of the feed water pipe, and capable of storing air existing in the feed water pipe in the interior, which is outside of the tubular portion, of the housing, the tubular portion is provided in an upper section thereof with (an) air hole(s) made through a wall thereof and causing the water supply passage to communicate with the interior of the housing.

In the muffling apparatus according to the first invention, the tubular portion is connected in a downwardly extending state to the upstream side feed water pipe portion, and the water supply passage in this tubular portion communicates with the feed water passage in the interior of the feed water pipe. The lower section of the tubular portion is enclosed with the housing. This housing is connected water-tightly to the upstream side feed water pipe portion, the upper section of the tubular portion and the downstream side feed water pipe portion, and capable of storing the air in the feed water pipe in the interior, which is outside of the tubular portion, of the housing. Owing to this arrangement, the air left in the feed water pipe in a case where fresh water is supplied to the feed water pipe is moved in the same feed water pipe by a water pressure. When this air reaches a lower section of the tubular portion, the air is moved reliably to the interior, which is outside of the tubular portion, of the housing owing to the buoyancy thereof. Accordingly, the air left in the feed water pipe is not moved directly into the downstream side feed water pipe portion. The air stored in the housing is necessarily discharged to the interior of the water supply passage through the air hole made through the wall of the upper section of the tubular portion since the air hole communicates the water supply passage with the interior of the housing. Thus, in this muffling apparatus, the air in the feed water pipe is not discharged in a lump at a stroke into the storage water, so that the occurrence of noise can be prevented.

Since this muffling apparatus does not have a branch pipe diverging from a feed water pipe and a valve operated in a housing unlike the above-described related art muffling apparatus, the number of parts of the apparatus is small, and the construction thereof is simple. This enables the reduction of the manufacturing cost to be attained, and an operation for assembling the apparatus to be carried out easily. Moreover, since this muffling apparatus does not have a movable member, such as a valve provided in the related art apparatus of this kind, a stable muffling effect can be displayed.

Therefore, according to the muffling apparatus of the first invention, the occurrence of noise can be prevented reliably with the reduction of the manufacturing cost and the easiness of an operation for assembling the apparatus attained. Since this muffling apparatus can display a muffling effect stably, the omission of maintenance work therefore can be attained.

In the muffling apparatus according to the first invention, it is preferable that an atmosphere-openable valve be connected to the upstream side feed water pipe portion. When such a valve is provided, the air stored in the housing is discharged from the atmosphere-openable valve to the atmospheric air via the water supply passage in the tubular portion after the feeding of water through the feed water pipe finishes. Therefore, the air is not stored excessively in the housing. Accordingly, when fresh water is subsequently supplied to the feed water pipe, the air left in the feed water pipe is moved reliably to the interior of the housing, and not to the downstream side feed water pipe portion, i.e., the water only is moved to the downstream side feed water pipe portion. Thus, in this muffling apparatus, the water only is sent out into the storage water, so that the occurrence of noise can be prevented.

In the muffling apparatus according to the first invention, it is preferable that the inner diameter of the water supply passage be larger than that of the feed water passage. When the water supply passage is formed in this manner, the air stored in the housing turns into small bubbles in order owing to a Venturi effect, and the bubbles are drawn out into the water supply passage. Therefore, after the feeding of water through the feed water pipe finishes, excessive air is not stored in the housing. The small bubbles are discharged with the discharge water little by little in to the storage water. Thus, in this muffling apparatus, the air in the feed water pipe is not discharged in a lump at a stroke into the storage water, so that the occurrence of noise can be prevented.

In the muffling apparatus according to the first invention, the housing is preferably connected to the feed water pipe so that at least a part of the interior of the housing is positioned lower than a level of the storage water. The reasons reside in that, when the water is discharged from the feed water pipe into the storage water, the level of the storage water increases, and, therefore, when a part of the interior of the housing is positioned lower than the level of the storage water, the air in the feed water pipe can be stored in the housing owing to the buoyancy of the air. Accordingly, when at least a part of the interior of the housing is originally positioned lower than the level of the storage water, the air in the feed water pipe can be stored reliably in the housing.

The muffling apparatus according to the first invention can be used for a feed water apparatus provided with a feed water pipe adapted to send out the water, which flows in a feed water passage in the interior thereof, into the storage water. Owing to this structure, the air in the feed water pipe is not discharged at a stroke into the storage water, so that a noise does not occur. This type of feed water apparatuses include, for example, a washing apparatus for Western style flush toilet stools and a hot water supply apparatus for bathtubs. The feed water apparatus according to the first invention produces a remarkable effect, especially, when a feed water pipe in the apparatus is a jet pipe used in a Western style toilet stool.

A feed water apparatus according to a second invention is a feed water apparatus connected to a jet port of a Western style flush toilet stool and adapted to send out water, flowing through a feed water passage therein, into storage water existing in the Western style flush toilet stool, the improvement is characterized in that a part of a downwardly extending feed water passage, through which said water is passed downward, of the feed water passage having a larger inner diameter, whereby the part of the downwardry extending feed water passage is used as a muffling portion adapted to stall air that is about to pass therethrough with the water.

In the feed water apparatus according to the second invention, a part of the downwardly extending feed water passage, in which the water is passed downward, of the feed water passage system is formed as a muffling portion. Since this muffling portion is formed to an increased inner diameter, the muffling portion has a function of stalling the air which is about to pass with the water therethrough. Namely, when fresh water is supplied to the feed water passage system, the air left therein is moved in the downwardly extending feed water passage by a water pressure. When the air reaches the muffling portion, the air is stalled due to the buoyancy working thereon. Therefore, the air left in the feed water passage system is not moved directly to a downstream side of the downwardly extending feed water passage, and the air stored in an upper section of the muffling portion turns into very small bubbles, which are drawn out into the water. These small bubbles with the discharge water are sent out little by little into the storage water. Thus, in this feed water apparatus, the air in the feed water passage system is not discharged in a lump at a stroke into the storage water, so that the occurrence of noise can be prevented.

In this feed water apparatus, a branch pipe diverging from a feed water pipe and a valve moving in a housing which are provided in the above-described related art muffling apparatus are not provided. Therefore, the number of parts of the apparatus is small, and the construction thereof is simple. Especially, the muffling portion, in which the inner diameter of the downwardly extending feed water passage is increased, is thereby formed to only a columnar structure, so that the construction of this portion is very simple. This enables a decrease in the manufacturing cost to be attained, and the assembling work to be carried out easily. Moreover, since this feed water apparatus does not have a movable member, such as a valve which is provided in the related art apparatus of this kind, a stable muffling effect is displayed.

Therefore, according to the feed water apparatus of the second invention, the prevention of noise can be attained reliably with a decrease in the manufacturing cost and easy assembling work made concrete. Since this feed water apparatus can display a muffling effectstably, the omission of maintenance work therefore can be attained.

The feed water passage can be formed by a tubular feed water pipe. In this case, the feed water pipe preferably has a muffling portion made integral therewith. As a result, it becomes unnecessary to additionally provide a muffling portion at an end of the feed water pipe, so that the assembling of the feed water pipe becomes further easier.

BEST MODE FROM CARRYING OUT THE INVENTION

The modes 1 to 4 of embodiments in which the first invention is made concrete, and the mode 5 of embodiment in which the second invention is made concrete will be described with reference to the drawings.

Mode 1 of Embodiment

Figure 1:
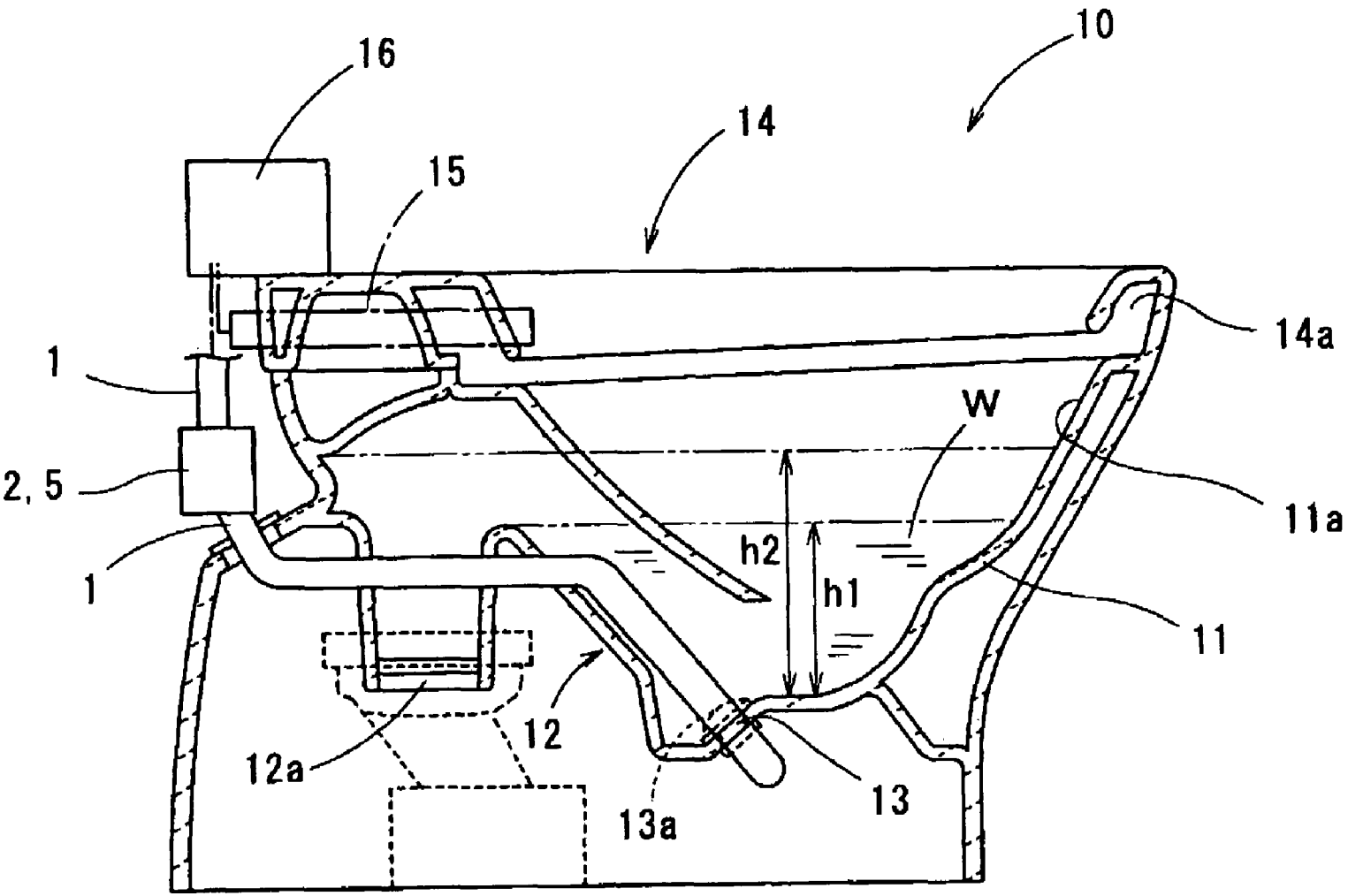
FIG. 1 is a sectional view of a Western style flush toilet stool provided with the muffling apparatuses in the modes 1 and 2 of embodiments.
Figure 2:
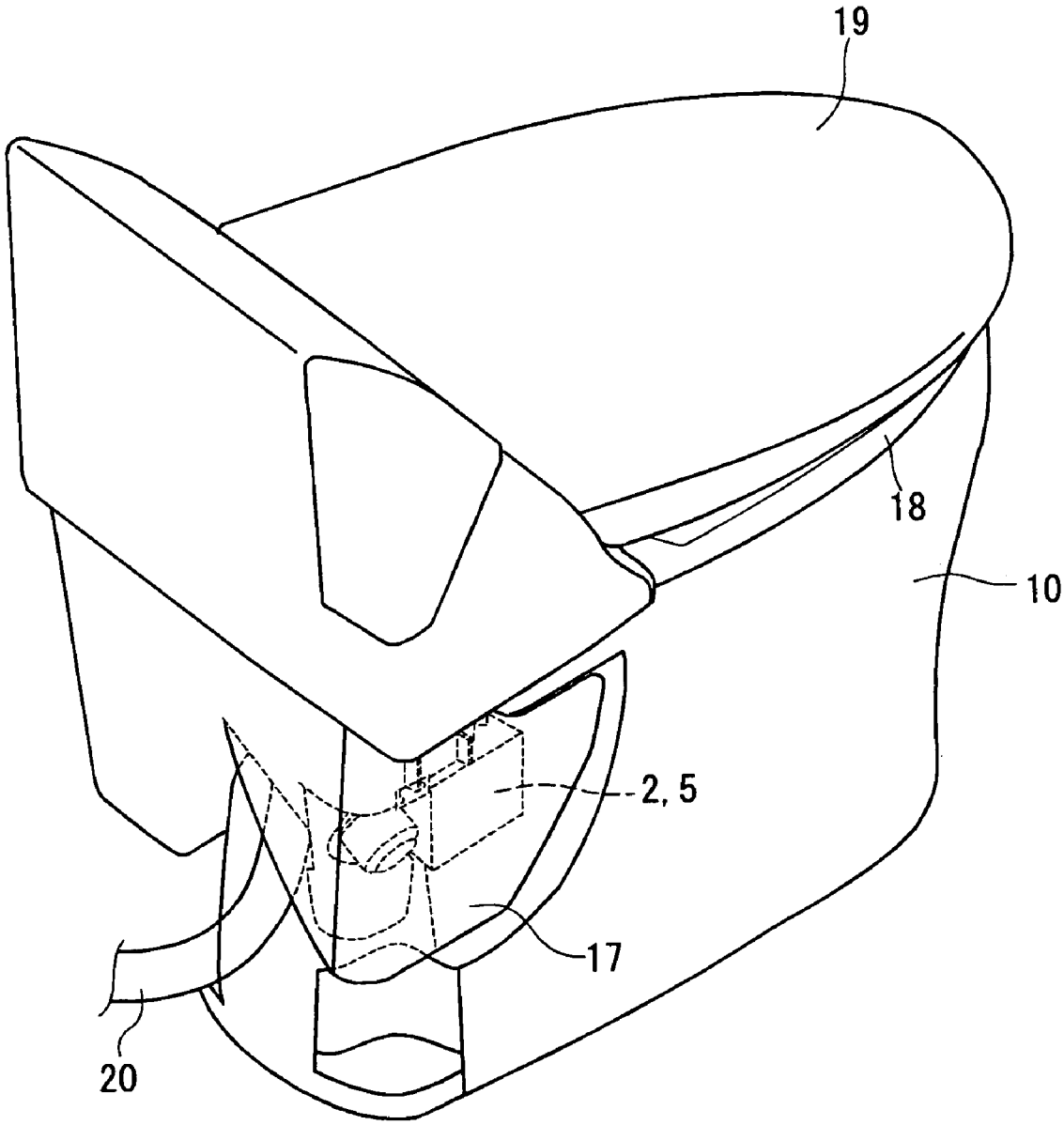
FIG. 2 is a perspective view of the Western style flush toilet stool provided with the muffling apparatuses in the modes 1 and 2 of embodiments.
Figure 3:
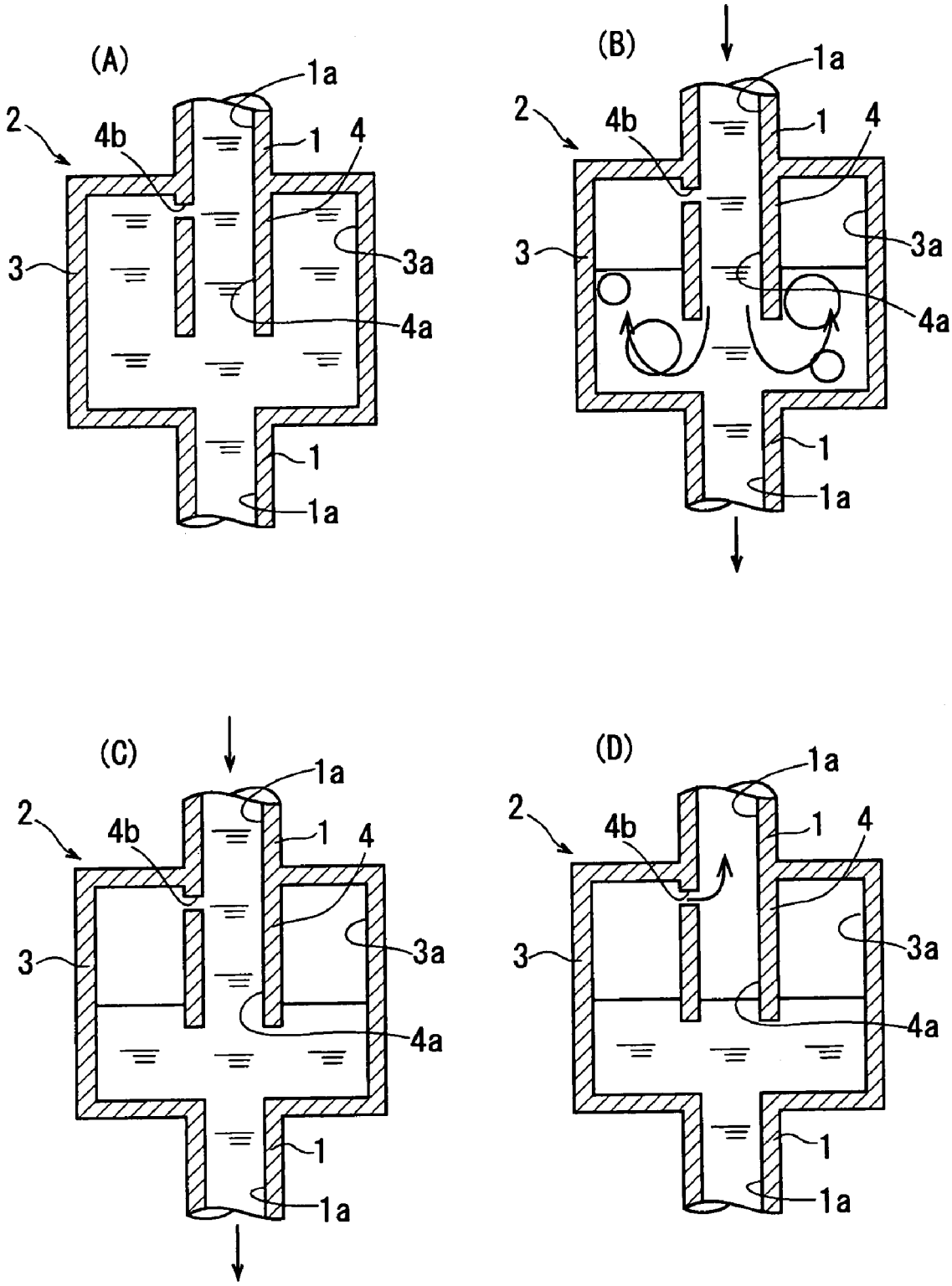
FIG. 3 is a sectional view of the muffling apparatus in the mode 1 of embodiment.

As shown in FIG. 1 and FIG. 2, a muffling apparatus 2 in the mode 1 of embodiment is used for a Western style flush toilet stool. In this Western style flush toilet stool, a porcelain toilet body 10, and a washing apparatus 16 provided in an inner portion thereof with two valves (not shown) and two atmosphere-openable valves (not shown). In FIG. 1, the illustrations of a seat 18 and a cover 19 are omitted.

As shown in FIG. 1, the toilet body 10 is provided with a bowl portion 11 having a bowl surface 11*a*, and a trap portion 12 formed so as to be joined to a bottom section of the bowl portion 11. The trap portion 12 has an inverted U-shaped form, and is joined to a discharge port 12*a* at a lower section thereof.

At a bottom portion of storage water W in the trap portion 12, a jet nozzle 13 is fixed. A free end within the trap portion 12 of this jet nozzle 13 forms a jet port 13*a*. The jet nozzle 13 is connected to the washing apparatus 16 by a jet pipe 1 as a feed water pipe. Outside of the toilet body 10, a muffling apparatus 2 is provided in an intermediate portion of the jet pipe 1. The muffling apparatus 2 is hidden behind a cover 17 fixed to the toilet body 10 as shown in FIG. 2.

As shown in FIGS. 3A to 3D, the muffling apparatus 2 is provided in an intermediate portion of the jet pipe having a feed water passage 1*a*, i.e., between an upstream side jet pipe portion 1 and a downstream side jet pipe portion 1 so as to become integral therewith. This muffling apparatus 2 is provided with a housing 3 and a tubular portion 4. The tubular portion 4 has in an inner section thereof a water supply passage 4*a* communicating with a feed water passage 1*a*, and is connected to the upstream side jet pipe 1 portion so as to extend downward. The inner diameter of the feed water passage 1*a* and that of the water supply passage 4*a* are equal to each other. The housing 3 is connected water-tightly to the upstream side jet pipe portion land an upper section of the tubular portion 4, encloses a lower section of the tubular portion 4 therewith, and is connected water-tightly to the downstream side jet pipe portion 1. In the interior of the housing 3 which corresponds to the exterior of the tubular portion 4, an air chamber 3*a* capable of storing there in the air in the jet pipe 1. The tubular portion 4 is provided at an upper section thereof with an air hole 4*b* made through a wall thereof and communicating the water passage 4*a* with the air chamber 3*a*.

As shown in FIG. 1, this muffling apparatus 2 is connected to the jet pipe 1 so that a part of the air chamber 3*a* is in a position lower than a height h1 of a level of the storage water W measured from the bottom section of the bowl portion 11.

At an upper section of the bowl portion 11, a rim (so-called open rim) 14 having an opened rim water passage 14*a* therein is formed. At a rear upper section of the bowl portion 11, a rim pipe 15 connected to a washing apparatus 16 and opened at a free end thereof in the rim water passage 14*a* is provided. The washing apparatus 16 is connected directly to a city water pipe (not shown) by a flexible hose 20 as shown in FIG. 2.

When a water discharge button switch (not shown) on a toilet stool body or on a remote controller is pressed in this Western style flush toilet stool, the washing apparatus 16 opens one valve first, and supplies water to only the rim water passage 14*a* via the rim pipe 15. As a result, the washing water is discharged horizontally along an upper end of the toilet stool, and this washing water washes the surface 11*a* of the bowl portion 11 as the washing water flows down on the same surface. Consequently, the level of the storage water W rises to a position of a height h2 measured from the bottom section of the bowl portion 11. The washing apparatus 16 then closes the mentioned valve. At this time, the interior of the air chamber 3*a* and water passage 4*a* in the muffling apparatus 2 is put in a washing water-filled state as shown in FIG. 3A.

The washing apparatus 16 then opens the other valve, and supplies the water to only the jet nozzle 13 via the jet pipe 1. Immediately after the washing water is supplied to the jet pipe 1, the washing water flows from the upstream side jet pipe 1 positioned on the upper side into the downstream side jet pipe 1 positioned on the lower side due to a water pressure as shown in FIG. 3B. During this time, the air left in the jet pipe 1 is sent out in a lump from the feed water passage 1*a*, flows through the water passage 4*a*, and comes out from a lower section of the tubular portion 4. During the same time, this lump of air is moved to the outside of the tubular portion 4 by a buoyancy, and stored in the air chamber 3*a*. While the supplying of the washing water to the jet pipe 1 continues, the air left in the jet pipe 1 is wholly stored in the air chamber 3*a* as shown in FIG. 3C. As a result, the washing water is injected in the trap portion 12 from the jet port 13*a*. Owing to the washing water injected from the jet port 13*a*, a siphoning effect is forcibly generated. The sewage water possibly containing filth with the washing water is discharged to a discharge pipe (not shown) via a discharge port 12*a*.

The washing apparatus 16 then closes the second-mentioned valve 16. The atmosphere-openable valve connected to the jet pipe 1 is thereafter opened. As a result, the supplying of the washing water to the jet pipe 1 is stopped, so that the feed water passage l*a* and water supply passage 4*a* are opened into the atmospheric air as shown in FIG. 3D. The air stored in the air chamber 3*a* is discharged to the atmospheric air from the air hole 4*b* and through the water passage 4*a* and feed water passage 1*a* as shown by an arrow. Accordingly, the excess air is not stored in the air chamber 3*a*. Therefore, even when the fresh washing water is then supplied to the interior of the jet pipe 1, the air left in the jet pipe 1 is moved reliably to the interior of the air chamber 3*a*, and not to the downstream side section of the jet pipe 1, the water only being moved to the downstream side section of the jet pipe 1. Thus, in this muffling apparatus 2, the air in the jet pipe 1 is not discharged in a lump at a stroke into the storage water W, so that the occurrence of noise can be prevented.

Since this muffling apparatus 2 does not have a branch pipe diverging therefrom and a valve movable in the housing unlike the related art muffling apparatus, the number of parts of the apparatus is small, and the construction thereof is simple. Therefore, the reduction of the manufacturing cost can be attained, and the assembling work is carried out easily. Since this muffling apparatus 2 does not have a movable member such as a valve as provided in the related art apparatus of this kind, a stable muffling effect is displayed.

Therefore, according to the muffling apparatus 2 in the mode 1 of embodiment, the prevention of the occurrence of noise can be attained reliably with the reduction of the manufacturing cost and the easiness of the assembling work made concrete. Since this muffling apparatus 2 can display a muffling effect stably, the omission of maintenance work therefore can be attained.

Since this muffling apparatus 2 is provided on an outer portion of the toilet stool body 10, the muffling apparatus can be provided afterward on an existing Western style flush toilet stool. Moreover, this muffling apparatus 2 is hidden behind the cover 17 fixed to the toilet stool body 10, so that the external appearance of the Western style flush toilet stool is not spoiled.

Mode 2 of Embodiment

As shown in FIGS. 4A to 4D, a muffling apparatus 5 in the mode 2 of embodiment is used for the same Western style flush toilet stool as shown in FIGS. 1 and 2, in the same manner as the muffling apparatus in the mode 1 of embodiment.

Figure 4:
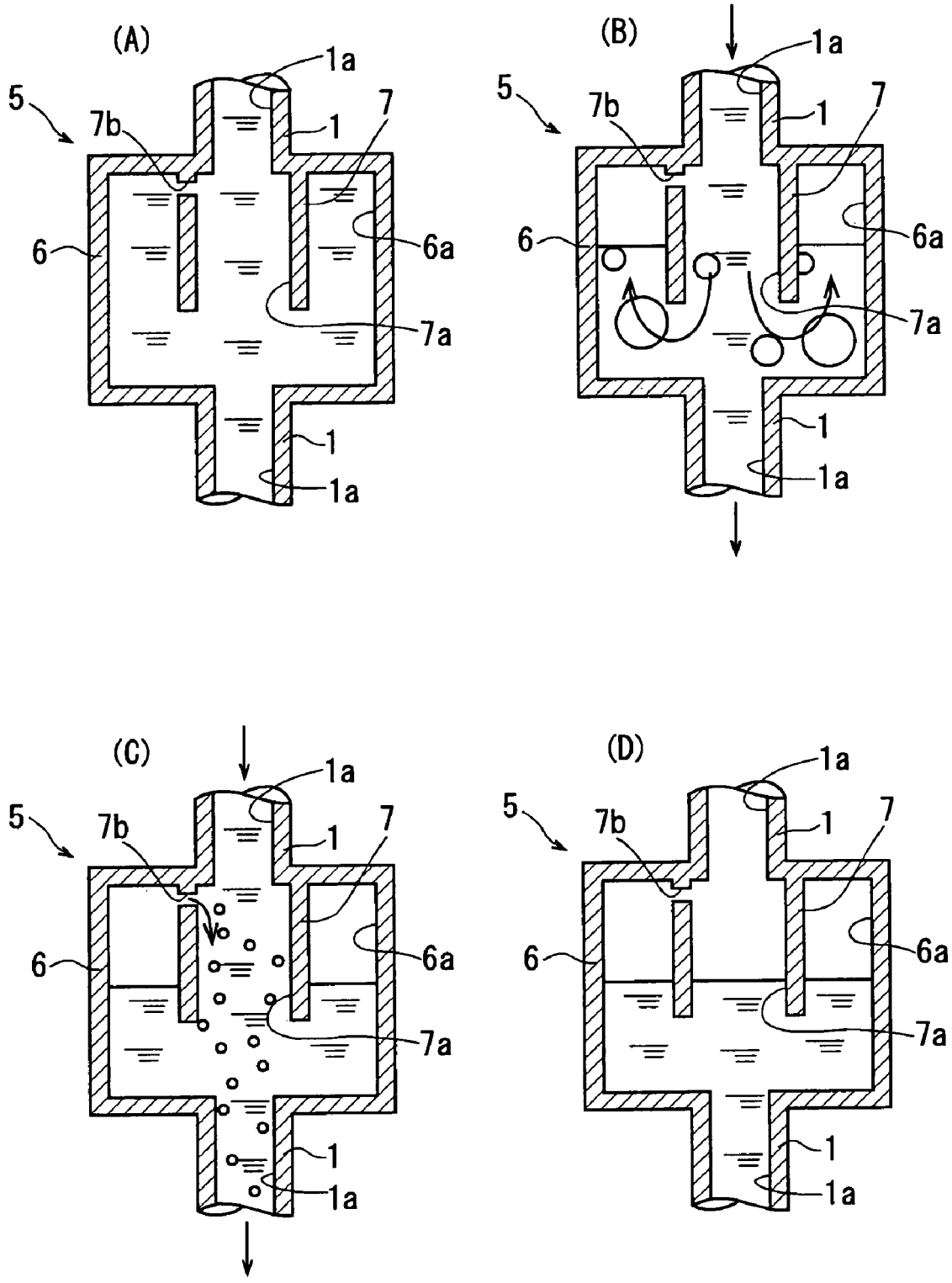
FIG. 4 is a sectional view of the muffling apparatus in the mode 2 of embodiment.

This muffling apparatus 5 is provided between jet pipe portions 1 having feed water passages 1*a*, i.e. between an upstream side jet pipe portion 1 and a downstream side jet pipe portion 1 so that the apparatus and pipe portions are in one body as shown in FIG. 4. This muffling apparatus 5 is provided with a housing 6 and a tubular portion 7. The tubular portion 7 has therein a water supply passage 7*a* communicating with the feed water passage 1*a*, and is connected to the upstream side jet pipe portion 1 so as to extend downward. The inner diameter of the water pipe 7*a* is set larger than that of the feed water passage 1*a*. The housing 6 is connected water-tightly to the upstream side jet pipe portion 1 and an upper section of the tubular portion 7, encloses a lower section of the tubular portion 7, and is connected water-tightly to the downstream side jet pipe 1. In the interior of the housing 6 which is outside the tubular portion 7, an air chamber 6*a* capable of storing therein the air in the jet pipe 1. The tubular portion 7 is provided in an upper section thereof with an air hole 7*b* communicating the water passage 7*a* with the air chamber 6*a* and made through a wall of the tubular portion 7. The construction of the other parts is identical with that of the corresponding parts of the mode 1 of embodiment. The structures identical with those shown in FIGS. 1 and 2 will be represented by the same reference numerals, and the description thereof will be omitted.

When a water discharge button switch (not shown) on a toilet stool body or on a remote controller in this Western style flush toilet stool is pressed, a washing apparatus 16 opens one valve, and supplies water to only a rim water passage 14*a* via a rim pipe 15. Consequently, the washing water is sent out horizontally along an upper end of the toilet stool, and washes a bowl surface 11*a* as the washing water flows down along the surface 11*a* of a bowl portion 11. As a result, the level of storage water W rises to a position of a height h2 measured from a bottom section of the bowl portion 11. The washing apparatus 16 then closes the same valve. During this time, the interior of the air chamber 6*a* and water passage 7*a* in the muffling apparatus 5 is put in a washing water-filled state as shown in FIG. 4A.

The washing apparatus 16 then opens the other valve, and supplies water to only the jet nozzle 13 via the jet pipe 1. Immediately after the washing water is supplied to the jet pipe 1, the washing water is moved from an upper side, i.e. an upstream side of the jet pipe 1 to a lower side, i.e. a downstream side thereof as shown in FIG. 4B by a water pressure. During this time, the air left in the jet pipe 1 is sent out in a lump from the feed water passage 1*a*, flows through the water supply passage 7*a*, and comes out from a lower section of the tubular portion 7. During the same time, the lump of the air is moved to the outside of the tubular portion 7 owing to a buoyancy, and stored in the air chamber 6*a*. While the supplying of the washing water to the jet pipe 1 continues, the air left in the jet pipe 1 is wholly stored in the air chamber 6*a* as shown in FIG. 4C. Since the inner diameter of the water passage 7*a* is set larger than that of the feed water passage 1*a*, the washing water flowing through the feed water passage 1*a* is diffused in the water supply passage 7*a*, and a velocity of flow of the washing water comes to lower. This causes a water pressure in an upper portion of the water supply passage 7*a* to become lower than that in a lower portion thereof, so that the air stored in the air chamber 6*a* turns into very small bubbles, which are drawn out (Venturi effect) little by little from the air hole 7*b* to the water passage 7*a*. The small bubbles are sent out with discharge water into the storage water W in a trap portion 12. Therefore, after the supplying of water through the jet pipe 1 finishes, the air in the housing 6 is substantially gone, or, even when the air is not gone, the air is not excessively stored therein. Since the air in the jet pipe 1 in this muffling apparatus 5 is not discharged in a lump at a stroke into the storage water W, the occurrence of a noise can be prevented.

The washing apparatus 16 then closes the second-mentioned valve. An atmosphere-openable valve connected to the jet pipe 1 is then opened. As a result, the supplying of the washing water to the jet pipe 1 is stopped, and the feed water passage la and water supply passage 7*a* are opened into the atmospheric air as shown in FIG. 4D. Other operation and effects are identical with those of the mode 1 of embodiment.

Mode 3 of Embodiment

Figure 5:
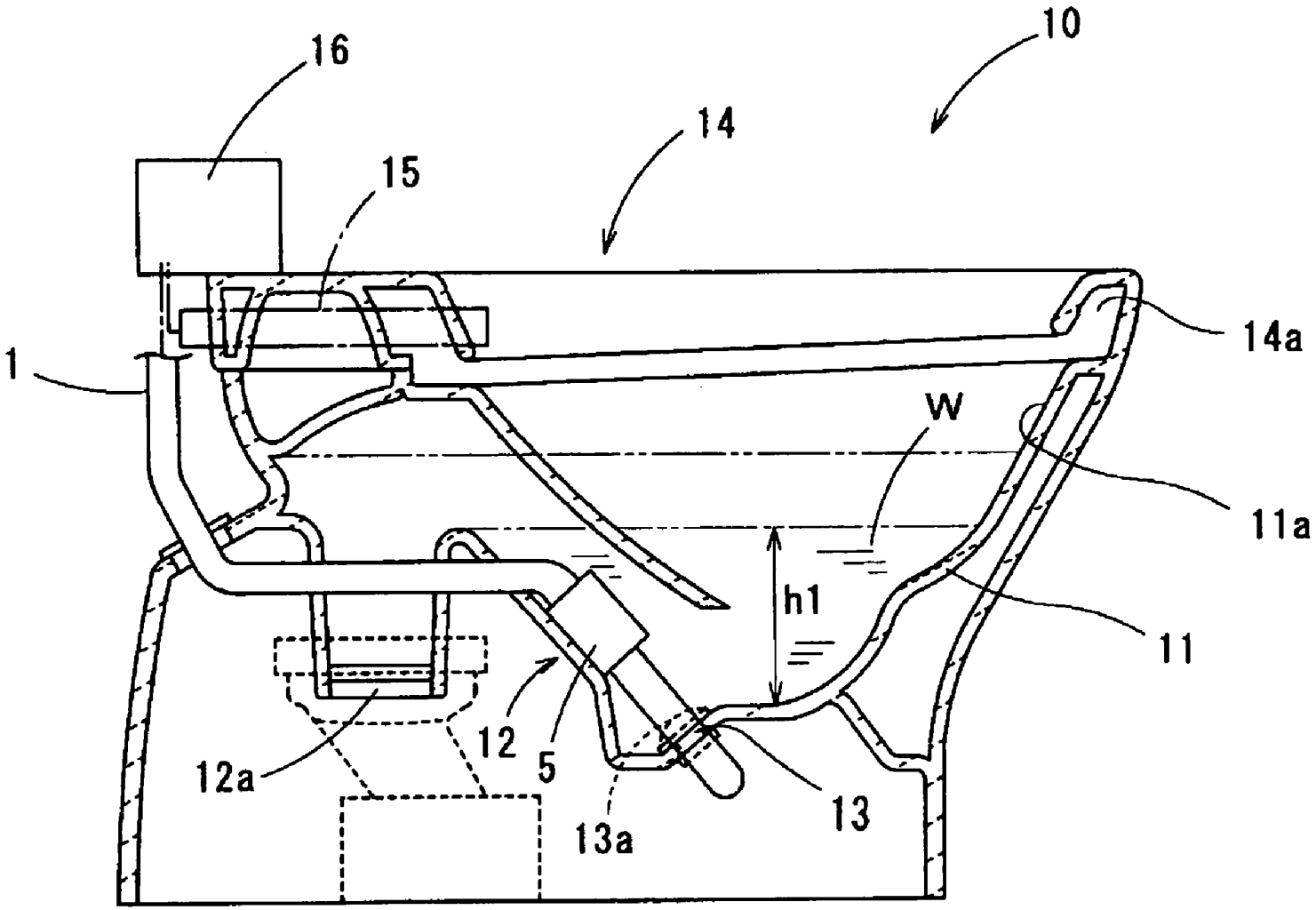
FIG. 5 shows a muffling apparatus in a mode 3 of embodiment, and is a sectional view of a Western style flush toilet stool.

In the mode 3 of embodiment, the same muffling apparatus 5 as that in the mode 2 of embodiment is provided in an inner portion of a toilet stool body 10 as shown in FIG. 5. The construction of the other parts is identical with that of the corresponding parts of the mode 2 of embodiment.

In this Western style flush toilet stool, the muffling apparatus 5 as a whole is in a position lower than a height h1 of the level of storage water W measured from a bottom section of a bowl portion 11 with a discharge water button switch (not shown) on a toilet stool body or on a remote controller not pressed, the interior of a housing 6 and a water supply passage 7*a* in the muffling apparatus 5 is put in a washing water-filled state as shown in FIG. 4A. The same applies to a case where the discharge water button switch is pressed with the washing apparatus 16 opening one valve to supply water to only a rim water passage 14*a* via a rim pipe 15.

When the washing apparatus 16 then opens the other valve and supplies water to only a jet nozzle 13 via a jet pipe 1, the muffling apparatus 5 turns from the condition shown in FIG. 4C into the condition shown in FIG. 4B in the same manner as in the mode 2 of embodiment. Thus, the air stored in an air chamber 6*a* comes to be substantially gone.

The washing apparatus 16 then closes the second-mentioned valve. An atmosphere-openable valve connected to the jet pipe 1 is then opened. As a result, even when the air is slightly left in the air chamber 6*a*, the air is moved from an air hole 7*b*, through a water supply passage 7*a*, and to an upstream side feed water passage 1*a*. Thus, the muffling apparatus 5 is put in the condition shown in FIG. 4A. Other operation and effects are identical with those in the mode 1 of embodiment.

Mode 4 of Embodiment

Figure 6:
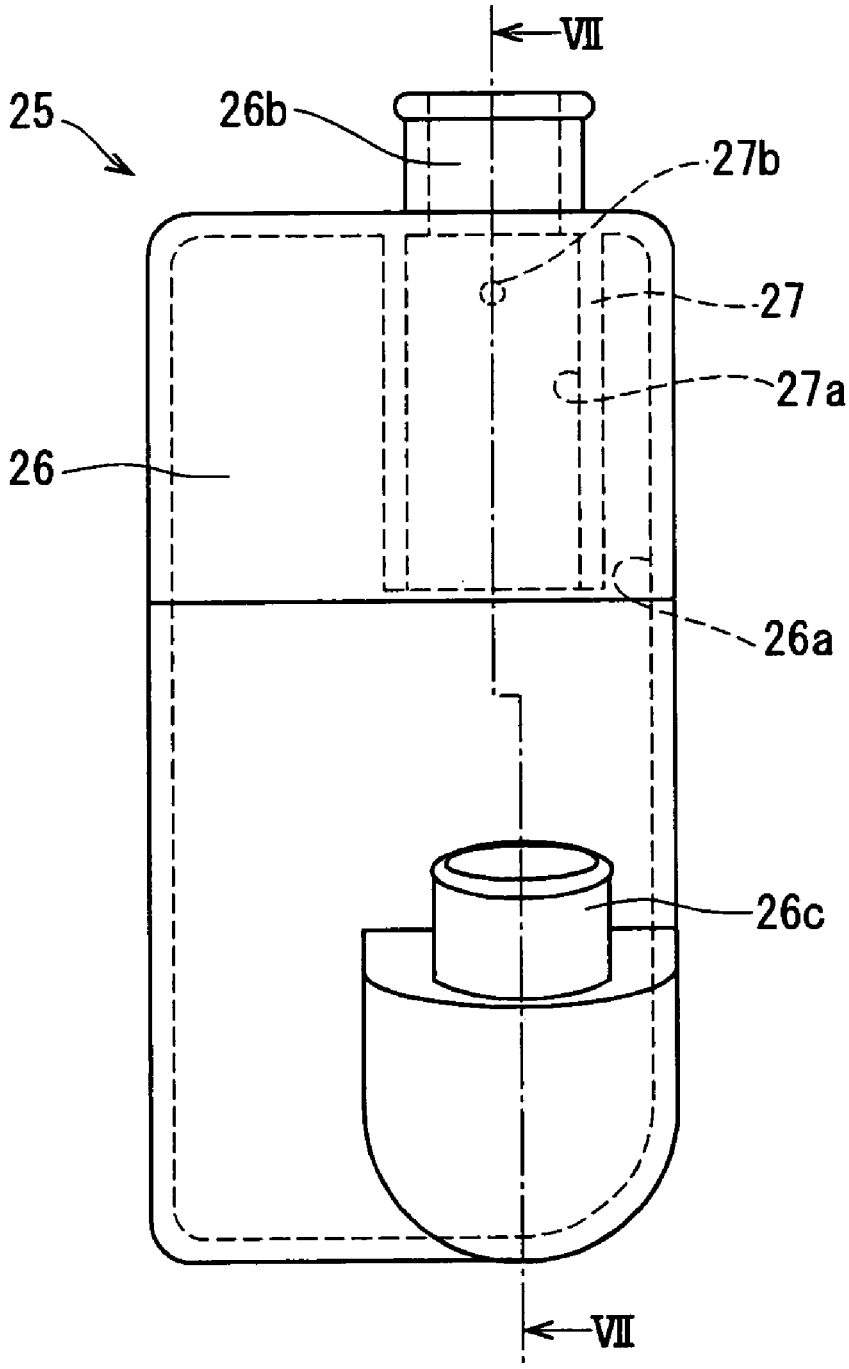
FIG. 6 is a front view of a muffling apparatus in a mode 4 of embodiment.
Figure 7:
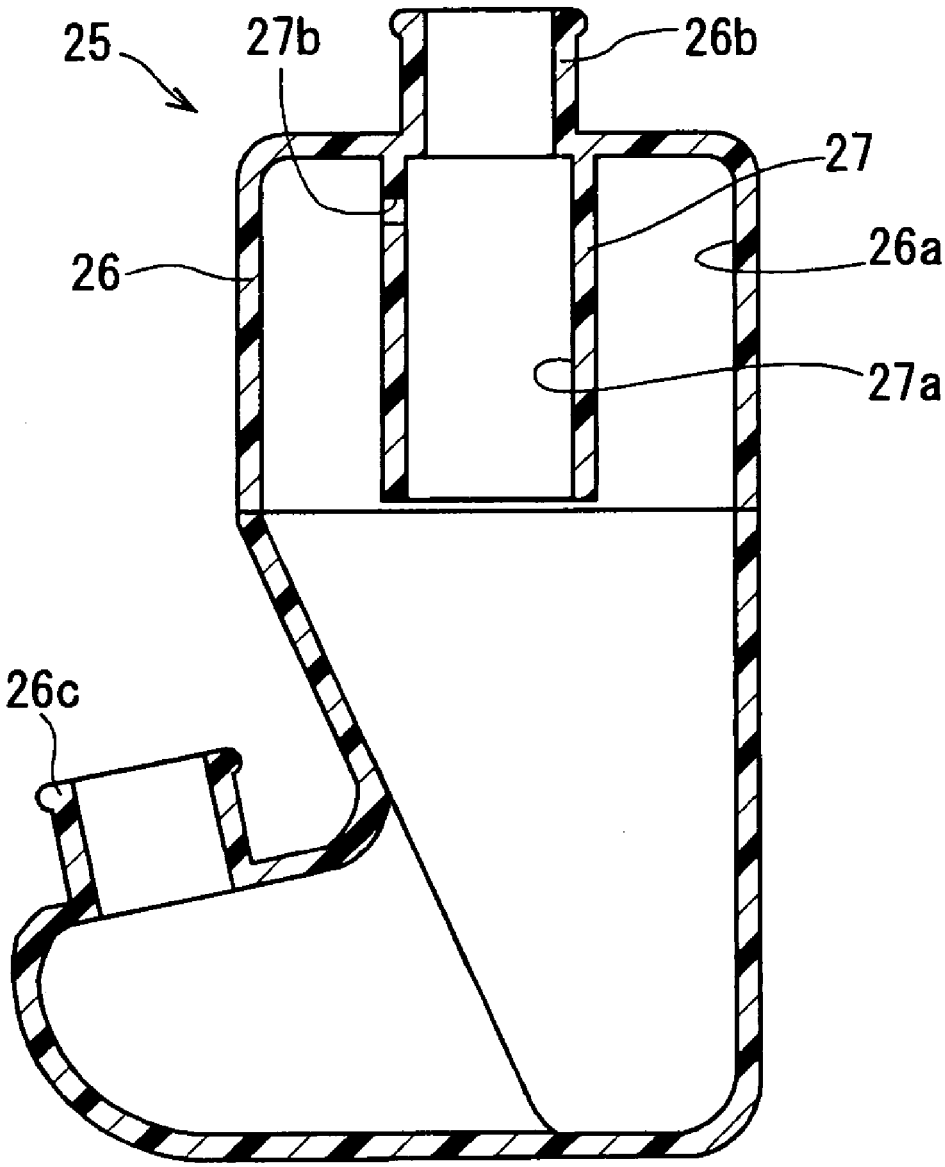
FIG. 7 shows a muffling apparatus in a mode 4 of embodiment, and is a sectional view taken along the line VII-VII shown by arrows in FIG. 6.

As shown in FIGS. 6 and 7, a muffling apparatus 25 in the mode 4 of embodiment is used for the same Western style flush toilet stool as is shown in FIGS. 1 and 2 in the same manner as the muffling apparatus in the mode 1 of embodiment. This muffling apparatus 25 is formed by making concrete the muffling apparatus 5 shown in FIG. 4.

This muffling apparatus 25 includes a housing 26 formed by fusing two resin members together and a tubular portion 27. The housing 26 is formed substantially in the shape of the letter "L". At an upper section of this housing 26, a connecting port 26*b* joined to an upstream side portion of a jet pipe 1 is provided so as to project upward. At a lower section of the housing 26, a connecting port 26*c* connected to a downstream side portion of the jet pipe 1 is also provided so as to project upward. The inner diameter of these connecting ports 26*b*, 26*c* is set substantially equal to that of a feed water passage 1*a* of the jet pipe 1.

In the housing 26, the tubular portion 27 communicating with the connecting port 26*b* is provided so that the tubular portion extend downward. The housing 26 is made integral with the tubular portion 27 at an upper section of the latter, and the housing 26 encloses a lower section of the tubular portion 27. The tubular portion 27 has in an inner section thereof a water supply passage 27*a* communicating with a feed water passage 1*a* of the jet pipe 1 and connected to an upstream side jet pipe 1 so that the water passage 27*a* extends downward though a connecting port 26*b*. The inner diameter of the water passage 27*a* is set larger than that of the connecting port 26*b*. In the interior, which is on the outer side of the tubular portion 27, of the housing 26, an air chamber 26*a* capable of storing therein the air in the jet pipe 1 is formed. In an upper section of the tubular portion 27, an air hole 27*b* for communicating the water supply passage 27*a* with the air chamber 26*a* is provided through a wall of the tubular section. The construction of the other parts is identical with that of the corresponding parts of the mode 2 of embodiment.

This Western style flush toilet stool can also attain the same operation and effects as in the mode 2 of embodiment. The muffling apparatus 2 shown in FIG. 3 can also be embodied in the same manner.

Mode 5 of Embodiment

Figure 8:
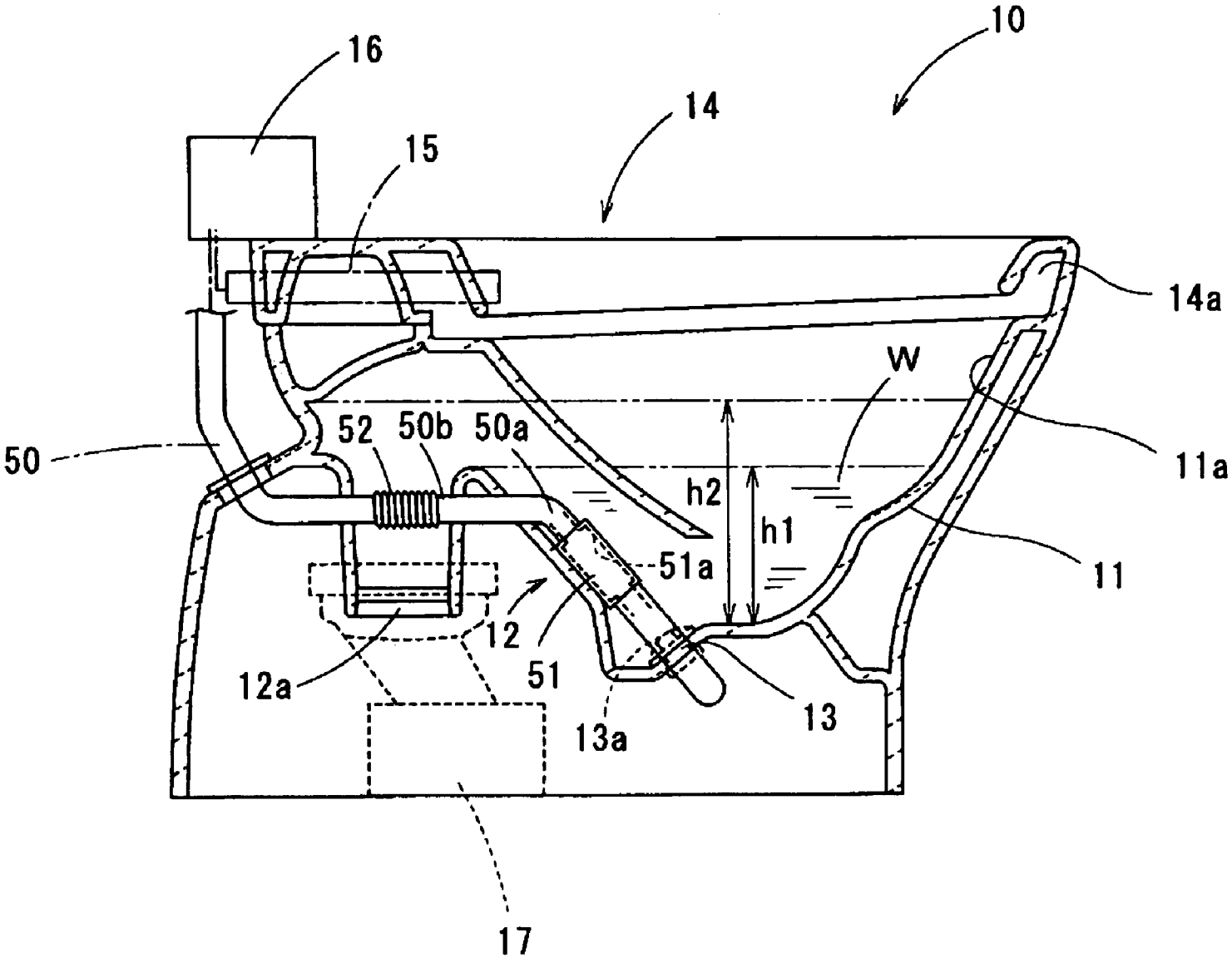
FIG. 8 is a sectional view of a Western style flush toilet stool provided with a feed water apparatus in a mode 5 of embodiment.

As shown in FIG. 8, a feed water apparatus of the mode 5 of embodiment is also used for a Western style flush toilet stool. In this Western style flush toilet stool, a jet nozzle 13 is fixed to a bottom section of a trap portion 12 filled with storage water W. A free end, which is in the trap portion 12, of the jet nozzle 13 forms a jet port 13*a*. The jet nozzle 13 is connected to a washing apparatus 16 by a jet pipe 50 serving as a feed water pipe the interior of which forms a feed water passage. The jet pipe 50 has a downwardly extending feed water pipe 50*a* adapted to make the water to flow down therethrough, and a horizontal feed water pipe 50*b* positioned on the upstream side of the downwardly extending feed water pipe 50*a* and adapted to make the water to flow horizontally or substantially horizontally therethrough. The downwardly extending feed water pipe 50*a* has a muffling portion 51 formed in a body thereon.

This muffling portion 51 is provided therein with a space 51*a* formed to a columnar shape. The space 51*a* is formed to an inner diameter larger than that of the downwardly extending feed water pipe 50*a*, and works so as to stall the air which is about to pass therethrough with the water. The muffling portion 51 is positioned lower than a level of a height h1 of storage water W which is measured from a bottom section of a bowl portion 11. The horizontal feed water pipe 50*b* is provided with bellows 52 for absorbing a tolerance of the Western style flush toilet stool. The construction of the other parts is identical with that of the corresponding parts of the mode 1 of embodiment shown in FIG. 1, and the same reference numerals will be used for the same structures, and a description thereof will be omitted.

Figure 9:
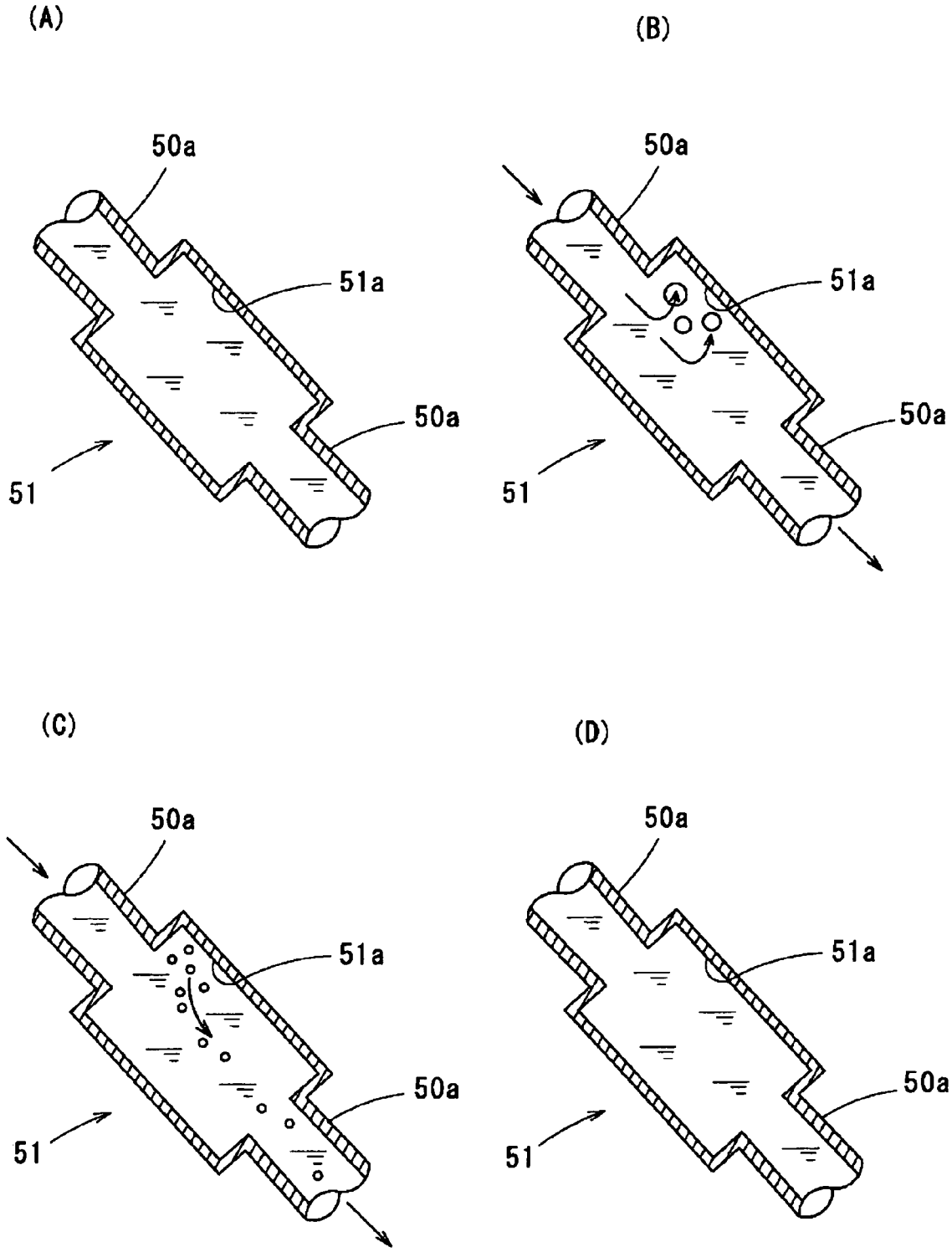
FIG. 9 is a sectional view of a muffling apparatus in the mode 5 of embodiment.

When a discharge water button switch (not shown) on a toilet stool body or on a remote controller is pressed in this Western style flush toilet stool, a washing apparatus 16 first opens one valve, and supplies water to only a rim water passage 14*a* via a rim pipe 15. Consequently, the washing water is sent out horizontally along an upper end of the toilet stool, and this washing water washes a bowl surface 11*a* of a bowl portion 11 as the washing water flows down along the bowl surface 11*a*. As a result, the level of the storage water W rises up to as high as a position of a height h2 measured from the bottom section of the bowl portion 11. The washing apparatus 16 then closes the same valve. At this time, the space 51*a* is put in a washing water-filled state as shown in FIG. 9A.

The washing apparatus 16 then opens the other valve, and supplies water to only a jet nozzle 13 via the jet pipe 50. Immediately after the washing water is supplied to the jet pipe 50, the washing water is moved as shown in FIG. 9B, from the horizontal feed water pipe 50*b*, an upstream side portion of the jet pipe 50 to the downwardly extending feed water pipe 50*a*, which is formed on the downstream side of the horizontal feed water pipe 50*b*, by a water pressure. During this time, the air left in the jet pipe 50 advances in the form of a lump with the washing water into the muffling portion 51. Since the inner diameter of the space 51*a* in the muffling portion 51 is set larger than that of the downwardly extending feed water pipe 50*a*, a buoyancy works greatly on the air advanced into the space 51*a* to cause the air to be stalled and stored in an upper section of the space 51*a*. The air about to pass with the water through the space 51*a* is stalled a little by the bellows 52 as well. While the supplying of the washing water to the jet pipe 50 continues, the air left in the jet pipe 50 is wholly stored in the upper section of the space 51*a*, and this air stored is drawn out as very small bubbles into the water as shown in FIG. 9C. The small bubbles are sent out with the discharge water into the storage water W in the trap portion 12. Therefore, after the supplying of the water through the jet pipe 50 finishes, substantially the whole air in the space 51*a* is gone. Thus, in this feed water apparatus, the air in the jet pipe 50 is not discharged in a lump at a stroke into the storage water W, so that the occurrence of a noise can be prevented.

The washing apparatus 16 then closes the second-mentioned valve, so that the supplying of the washing water to the jet pipe 50 is stopped with an atmosphere-openable valve, which is connected to the jet pipe 50, opened. As a result, the space 51*a* is put in a washing water-filled state as shown in FIG. 9D. Other operation and effects are identical with those of the mode 1 of embodiment.

Unlike the above-described related art muffling apparatus, this feed water apparatus does not have a branch pipe diverging from the jet pipe and a valve moved in the housing. Accordingly, the number of parts of the apparatus is small, and the construction thereof is simple. Especially, the muffling portion 51 is merely formed to a columnar shape due to the inner diameter increased of the jet pipe 50, and very simple in construction. Therefore, the reduction of the manufacturing cost can be attained, and the assembling work is easily carried out. Furthermore, this feed water apparatus does not have a movable member like a valve in the related art apparatus of this kind, so that a stable muffling effect can be displayed. In the feed water apparatus in this embodiment, the muffling portion 51 is provided with the jet pipe 50 combined therewith in one body. Accordingly, it is unnecessary to combine the muffling portion 51 with the jet pipe 50, so that the operation for assembling the feed water apparatus becomes easier.

Therefore, according to the feed water apparatus in the mode 5 of embodiment, the prevention of the occurrence of a noise can be attained reliably with the reduction of the manufacturing cost and the easiness of the assembling work made concrete. Since this feed water apparatus can display a muffling effect stably, the omission of maintenance work therefore can be attained. This feed water apparatus can be fixed to Western style flush toilet stool of various sizes by using the bellows 52. Although a columnar member is used as the muffling portion 51 in this feed water apparatus, the muffling portion is not necessarily made columnar as long as the inner diameter of the space 51*a* is larger than that of the downwardly extending feed water pipe 50*a*.

These modes of embodiments are examples of the present invention. The invention can be practiced in a mode in which various modifications are added within the scope not departing from the gist thereof.

INDUSTRIAL APPLICABILITY

The muffling apparatus or feed water apparatus according to the present invention is practiced suitably in a concrete manner as a washing apparatus for a Western style flush toilet stool, a hot water supply system for a bathtub, etc.

The invention claimed is:

1. A feed water apparatus connected to a jet port of a Western style flush toilet stool and adapted to send out water, flowing through a feed water passage therein, into storage water existing in said Western style flush toilet stool, comprising:

a downwardly extending feed water pipe adapted to pass the water downward therethrough; and a horizontal feed water pipe configured to be in fluid communication with the downwardly extending feed water pipe and adapted to pass the water horizontally or substantially horizontally therethrough, wherein said downwardly extending feed water pipe has a cylindrical muffling portion which is combined therewith in one body, is adapted to stall air that is about to pass therethrough with the water owing to a larger inner diameter of said muffling portion, and water passing through said muffling portion draws out the stalled air in the form of very small bubbles, said horizontal feed water pipe is provided with bellows which will stall air contained in the feed water.

2. A feed water apparatus according to claim 1, wherein said feed water passage is formed by a tubular feed water pipe.

* * * * *